US005788130A

United States Patent [19]

Todd et al.

[11] Patent Number: 5,788,130

[45] Date of Patent: Aug. 4, 1998

[54] SOCK PROCESSING APPARATUS AND METHOD

[75] Inventors: William H. Todd, Winston-Salem; Joseph L. Collins, Jr., Clemmons; Thomas A. Reavis, King, all of N.C.

[73] Assignee: Todd Motion Controls, Inc., Winston Salem, N.C.

[21] Appl. No.: 784,604

[22] Filed: Jan. 21, 1997

[51] Int. Cl.[6] ..... A41H 33/00; B31F 7/00; B31F 1/10

[52] U.S. Cl. ..... 223/37; 493/445; 493/444

[58] Field of Search ..... 223/37, 38; 493/442, 493/443, 444, 445

[56] References Cited

U.S. PATENT DOCUMENTS

| | | | |
|---|---|---|---|
| 44,640 | 10/1864 | Lockwood | 223/37 |
| 1,192,519 | 7/1916 | Hammond | 223/37 |
| 2,516,454 | 7/1950 | Doran | 493/444 |
| 3,901,501 | 8/1975 | Kistner | 493/444 |
| 3,926,425 | 12/1975 | Pierce et al. | 493/444 |
| 4,419,088 | 12/1983 | Nemec | 493/444 |
| 4,643,705 | 2/1987 | Bober | 493/444 |
| 5,042,227 | 8/1991 | Merry | 53/438 |
| 5,169,376 | 12/1992 | Ries et al. | 493/445 |
| 5,172,629 | 12/1992 | Merry | 100/35 |
| 5,309,828 | 5/1994 | Merry | 100/35 |
| 5,417,912 | 5/1995 | Merry | 264/320 |

*Primary Examiner*—Bibhu Mohanty

[57] ABSTRACT

A sock processing apparatus provides devices for folding, trimming, stacking, and compressing socks. The method provides folding socks by tucking them into a slot in a plate, closing a pair of rollers beneath the plate upon the socks, and thereafter pulling the socks through the slot under roller compression. The socks then move to a trimming station, where they are held in place while a trimmer removes excess threads. The socks are then stacked and moved to a compression station for compression prior to packaging.

24 Claims, 8 Drawing Sheets

SOCK PROCESSING APPARATUS AND METHOD

BACKGROUND OF THE INVENTION

1. Field of the Invention

The instant invention pertains generally to apparatus used to process finished textile products, and pertains specifically to apparatus used to fold, trim, stack and compress manufactured apparel such as socks.

2. Description of Related Art and Objectives of the Invention

In the modern textile industry, the key to competing successfully is to maintain maximum throughput from production equipment. In the manufacture of footwear such as socks, some of the most critical steps involve folding the socks into pairs, trimming, stacking and compressing the stacked socks. These steps must be completed before the socks can be bagged and shipped. Thus, the quicker the folding and trimming, the sooner the socks can be bagged and shipped and delivered. Also, each pair of socks must be folded uniformly to present a finished, clean appearance to the consumer. Therefore, the apparatus used to fold and trim the socks can be critical to the entire sock manufacturing and shipping processes.

Despite the efforts made by the industry to improve the methods of sock processing, there remains a need for sock folding and trimming apparatus that allows for quick, uniform processing while having a minimum of moving parts. The instant invention fulfills that need by providing a sock folding and trimming apparatus and method that is easy to operate, inexpensive to manufacture, and quick to integrate into most contemporary automated sock manufacturing processes.

Thus, a first objective of the present invention is to provide a sock folding apparatus that includes a plate defining an elongated rectangular slot, a pair of rollers positioned near that slot, and a blade suitable for tucking socks into the slot.

A second objective is; to provide a pair of rollers proximate the slot that are movable laterally toward one another to engage a sock, compress it, and pull it through the slot.

A third objective is to provide a method for folding socks including the steps of placing a pair of socks across a slotted plate, tucking the socks into the slot with a movable blade, closing a pair of rollers beneath the plate onto the tucked socks, and turning the rollers to pull the socks through the slot to thereby fold the same.

A fourth objective is to provide an adjustment device to suitably position a pair of socks prior to folding, a movable tucking blade, and a pair of rollers in electrical communication so sock pair movement can be specifically controlled.

A fifth objective is to provide sock trimming apparatus having a housing and a pair of reciprocating thread trimming blades.

A sixth objective is to provide a method of processing socks including the steps of folding the socks under compression, trimming any loose threads, stacking and compressing the socks.

Various other objectives and advantages of the present invention will become apparent to those skilled in the art as a more detailed description is set forth below.

SUMMARY OF THE INVENTION

A sock processing apparatus and method are provided. The apparatus includes a novel folding system having a plate with a rectangular slot, a blade positioned proximate the slot, and two rollers positioned beneath the plate. The method comprises the steps of placing a sock across the slot, tucking the sock into the slot with the blade to form a folded edge, engaging the edge on opposite sides with the rollers, and turning the rollers to pull the sock through the slot to fold the complete sock. The apparatus also includes stations for trimming, stacking, and compressing the socks.

The rollers are positioned on opposite sides of the slot therebeneath, and are movable toward and away from each other. Thus, the rollers can be moved into and out of engagement with a sock tucked through the slot. The rollers and the blade are driven by several conventional pneumatic units which are in electrical communication to ensure that all movements are precisely controlled and coordinated.

The apparatus further includes a novel sock trimming system having a housing and a pair of reciprocating blades. The housing provides means for attaching a vacuum source to the trimmer to allow a vacuum force to be directed through the pair of blades to draw any excess sock threads therein. Each of the blades define a plurality of rectangular openings having sharp edges through which the excess sock threads pass. When the blades reciprocate, the sock threads are sheared as the blades move in opposite directions causing the openings to close, cutting the threads.

DETAILED DESCRIPTION OF THE PREFERRED EMBODIMENT AND OPERATION OF THE INVENTION

Figure 1:
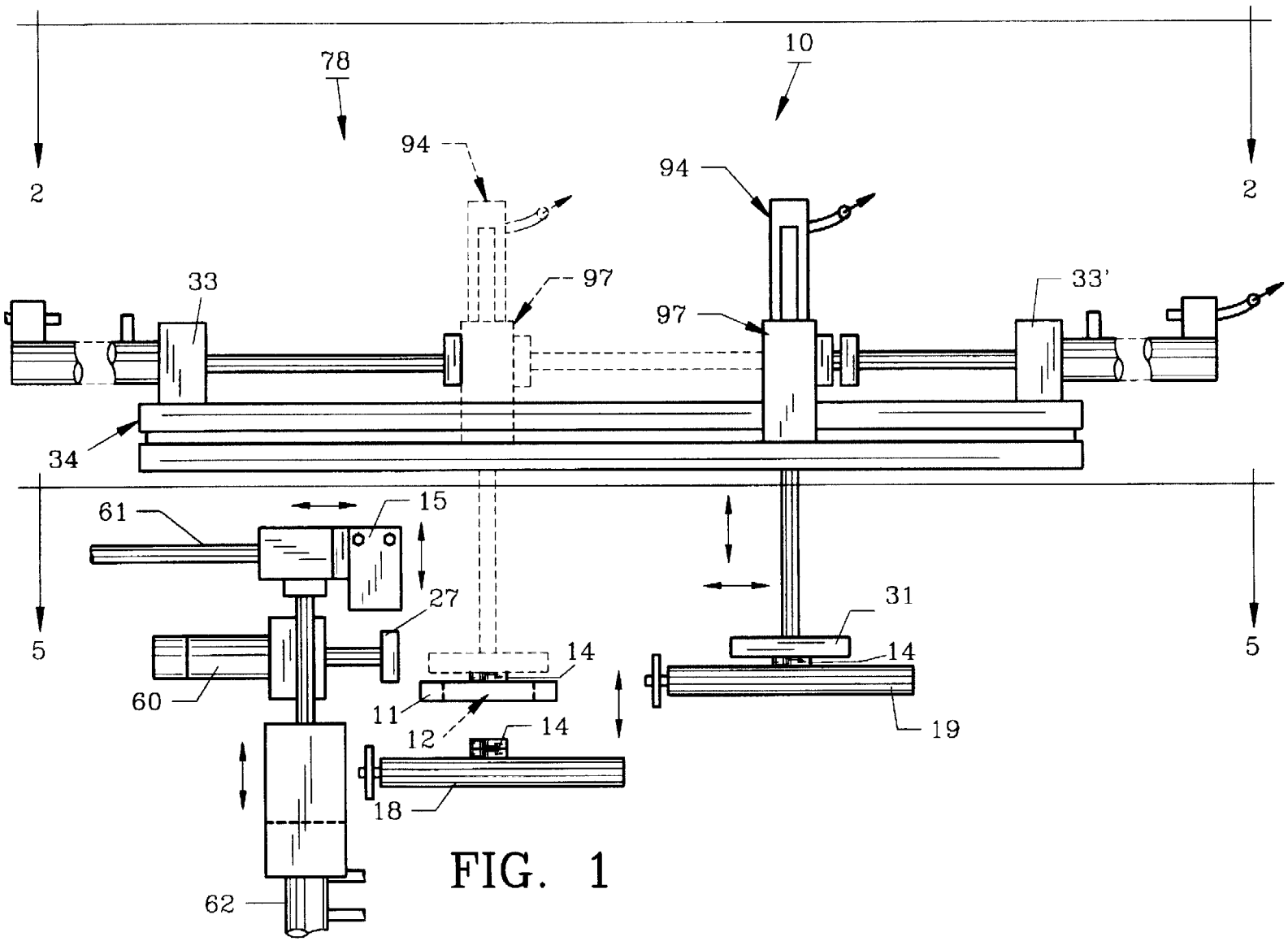
FIG. 1 is a side elevational view of the preferred form of the folding station of the sock processing apparatus.

For a better understanding of the invention, turning now to the drawings, FIG. 1 is a side elevational view of preferred folding station 78 of sock folding apparatus 10. A sock 14 approaches folding station 78 on upper conveyor 19 and is transferred precisely onto slotted folding plate 11 by vacuum plate 31, as shown in dotted lines. As would be understood, single socks or pairs of socks may be processed, depending on the particular requirements of the operator. Vacuum plate 31 travels slidably along carriage frame 34 between upper conveyor 19 and folding plate 11. Vacuum plate 31 moves both horizontally and vertically (by pneumatic unit 94) to lift and carry sock 14. Lateral carriage 97 supports pneumatic cylinder 94. Pneumatic shock absorbers 33 and 33' are positioned at each end of carriage frame 34 to dampen the impact of pneumatic unit 94 during travel between lower conveyor 19 and folding plate 11 along carriage frame 34.

Pair alignment device 27 is mounted proximate folding plate 11, and is activated by pneumatic unit 60. Pair alignment device 27 extends to rotate sock 14 horizontally into proper alignment along folding plate 11 before sock 14 is urged into slot 12 (see FIG. 5). Tucker blade 15 is also mounted proximate folding plate 11, and is activated by pneumatic units 61 and 62. Pneumatic unit 61 selectively moves blade 15 horizontally, while pneumatic unit 62 selectively moves blade 15 vertically. Thus, blade 15 is capable of precisely controlled two-dimensional motion. Blade 15 moves both horizontally and vertically and tucks sock 14 through folding plate slot 12, as explained in more detail below. Socks 14 move through folding plate 11 onto lower conveyor 18, and are then carried to trimming/stacking station 79.

Figure 2:
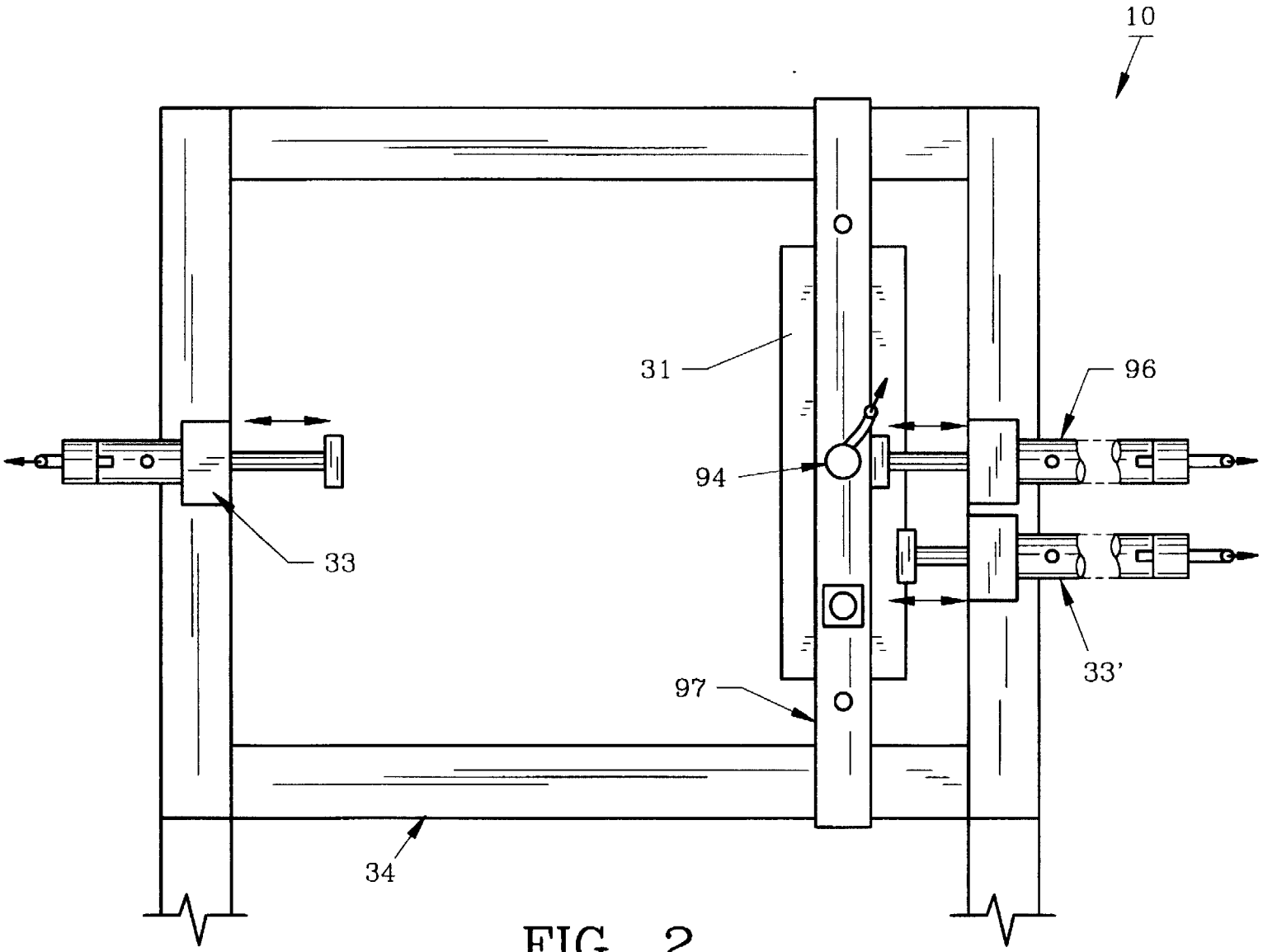
FIG. 2 is a top plan view of the apparatus of FIG. 1, taken along lines 2—2 in FIG. 1.

FIG. 2 is a top view of preferred apparatus 10 taken along lines 2—2 in FIG. 1. Pneumatic unit 96 drives lateral carriage 97 and vacuum plate 31 horizontally along carriage frame 34. FIG. 2 features vacuum plate 31, carriage frame 34, and shock absorbers 33 and 33'. Shock absorbers 33 and 33' are positioned at opposite ends of carriage frame 34 to cushion the impact of plate 31. As shown, pneumatic unit 94 moves vacuum plate 31 vertically.

Figure 3:
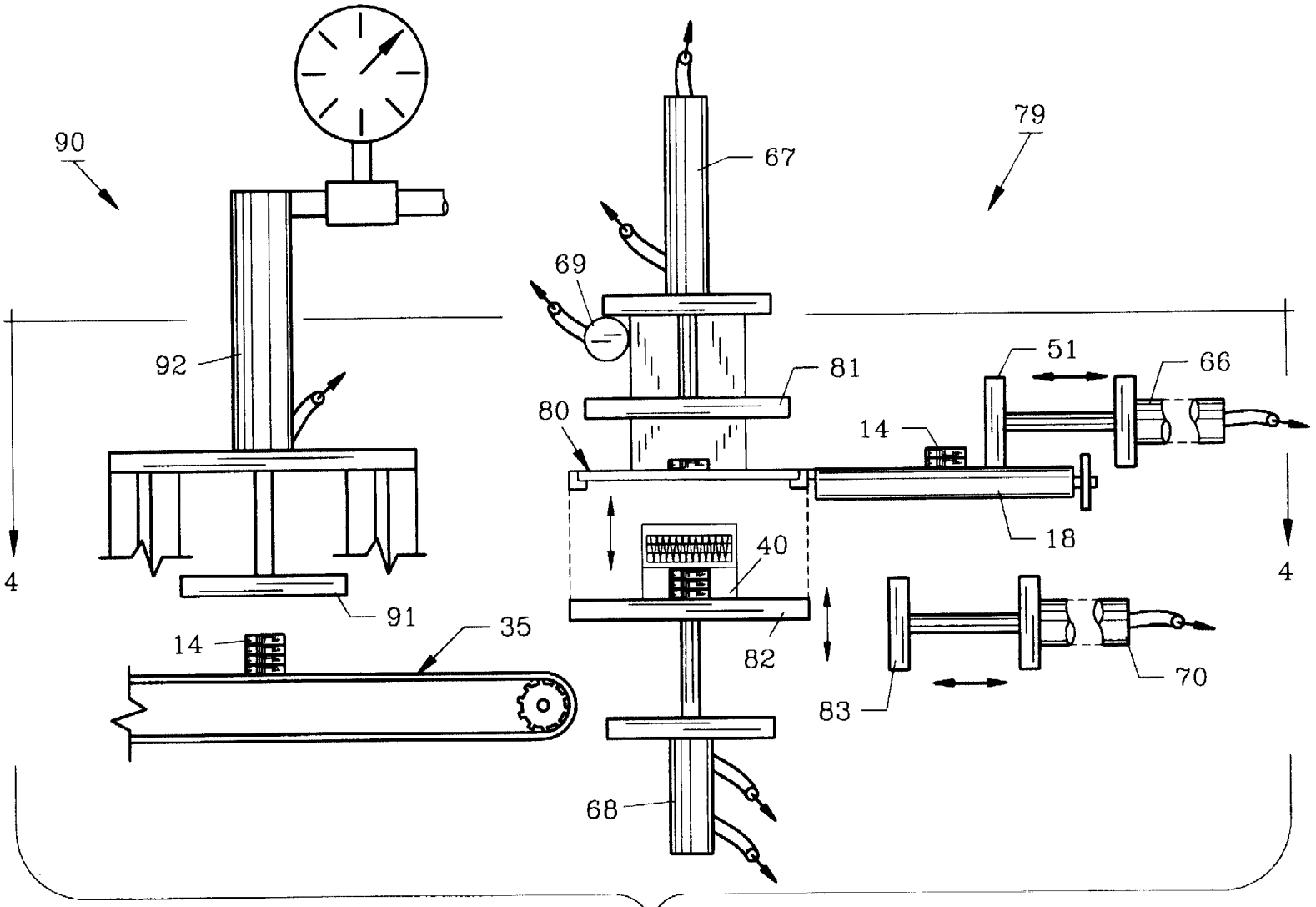
FIG. 3 is a side elevational view of the preferred trimming/stacking and compression stations of the apparatus.
Figure 4:
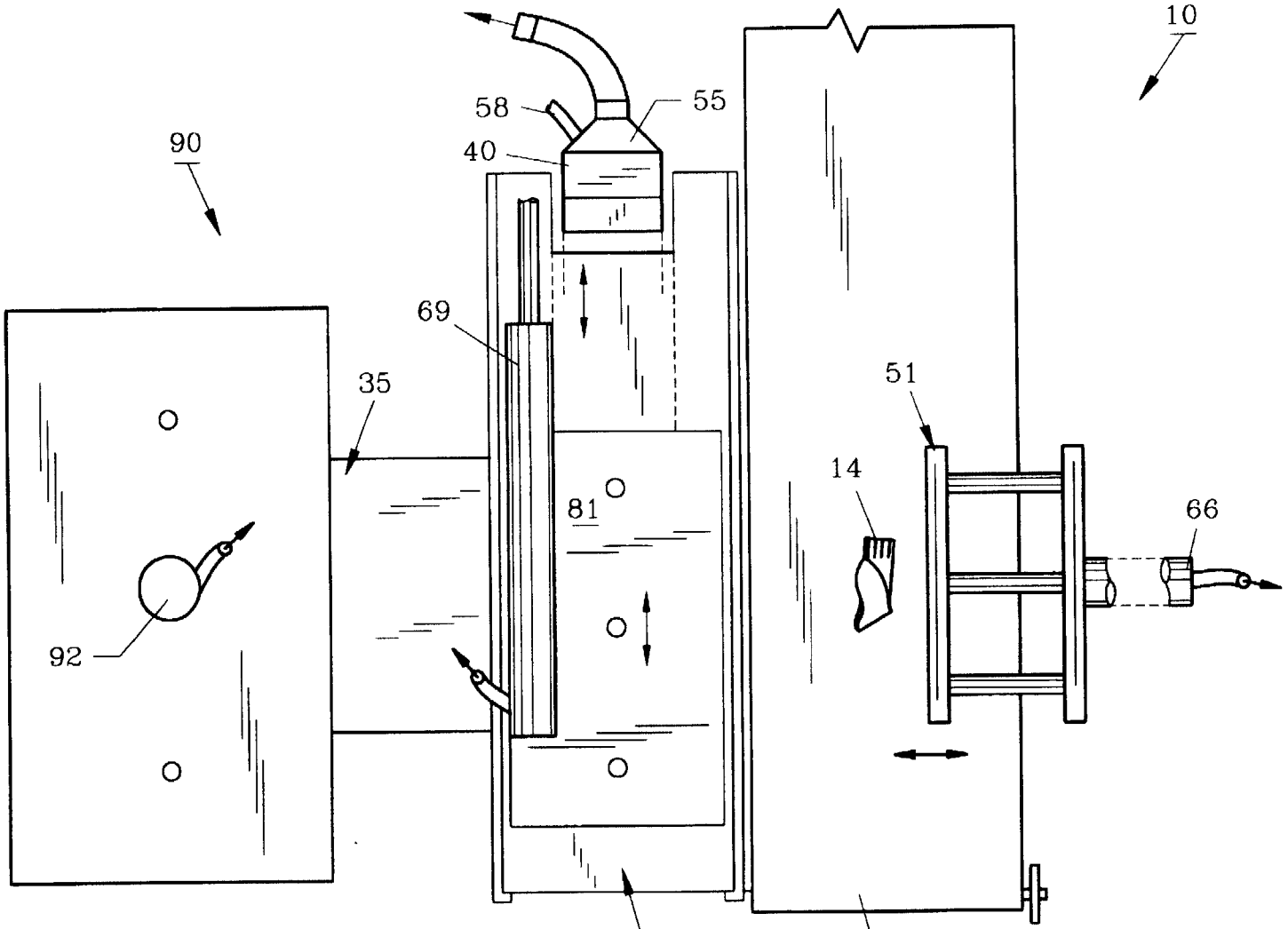
FIG. 4 is a top plan view taken along lines 4—4 in FIG. 3.

A side elevational view of trimming/stacking station 79 is seen in FIG. 3 along with compression station 90. Socks 14 are delivered to trimming/stacking station 79 on lower conveyor 18 after folding. Sock pusher 51 is located proximate lower conveyor 18, and is operated by pneumatic unit 66. When socks 14 are near trimming/stacking station 79, pair pusher 51 urges socks 14 onto dead plate 80. Upper stacker plate 81 is slidably mounted above dead plate 80, and is driven by upper pneumatic unit 67. Dead plate 80 is movable horizontally, and is driven by pneumatic unit 69 (FIG. 4). Upper stacker plate 81 lowers onto dead plate 80 to trap socks 14 therebetween. With socks 14 so held, trimmer head 40 (explained in more detail below) extends vertically (upwardly as seen in FIG. 3) and horizontally to trim loose threads extending from socks 14.

After socks 14 are so trimmed, trimmer head 40 and upper stacker plate 81 return to their rest positions (trimmer head 40 seen at rest in FIG. 4, upper stacker plate 81 shown at rest in FIG. 3). Lower pair stacker plate 82 is slidably positioned beneath dead plate 80, and is driven by lower stacking plate pneumatic unit 68. Any socks 14 remaining after trimming will be stacked atop lower stacker plate 82. After trimmer head 40 returns to rest position, lower stacker plate 82 is raised until it is just beneath dead plate 80. Dead plate 80 is moved horizontally, and socks 14 drop onto lower pair stacking plate 82 atop any socks 14 already stacked thereon. Upper and lower stacking plates then move to their at rest positions.

Stack pusher 83 is positioned proximate lower pair stacker plate 92, and is driven horizontally by stack pusher pneumatic unit 70. When socks 14 atop lower pair stacker plate 82 reach a preset number, such as two pairs, stack pusher 83 extends and drives socks 14 from lower stacker plate 82 onto conveyor 35, which is then level therewith to carry socks 14 into compression station 90.

Compression station 90 includes hydraulic cylinder 92 (FIG. 3) and compression plate 91. Compression plate 91 moves vertically and is driven by hydraulic cylinder 92. Socks 14 are positioned beneath compression plate 91, and hydraulic cylinder 92 lowers compression plate 91 to compress socks 14 to drive out air trapped therein. Conveyor 35 then activates to carry socks 14 from sock processing apparatus 10 for subsequent bagging, sealing, and shipping.

Top plan view taken along the line 4—4 in FIG. 3, shows trimming/stacking station 79 and compression station 90 in FIG. 4. There, folded socks 14 are pushed from lower conveyor 18 onto dead plate 80 by pair pusher 51, which is driven by pneumatic unit 66. Dead plate 80 is slidable horizontally (top to bottom in FIG. 4) and is seen in FIG. 4 in its rearward position. Dead plate 80 is moved by pneumatic unit 69. Upper pair stacking plate 81 is slidable vertically (see FIG. 3) and is mounted above dead plate 80. Trimmer head 40 is also shown in its rest position, withdrawn from dead plate 80 and upper stacking plate 81. Vacuum cowl 55 is shown in FIG. 4 attached to trimmer head 40, and is joined to a suitable vacuum source to draw negative pressure through trimmer head 40 along with excess sock threads. Conveyor 35 connects trimmer/stacking station 79 and compression station 90. Hydraulic cylinder 92 powers compression plate 91 (FIG. 3) to compress socks 14 for packing purposes.

Figure 5:
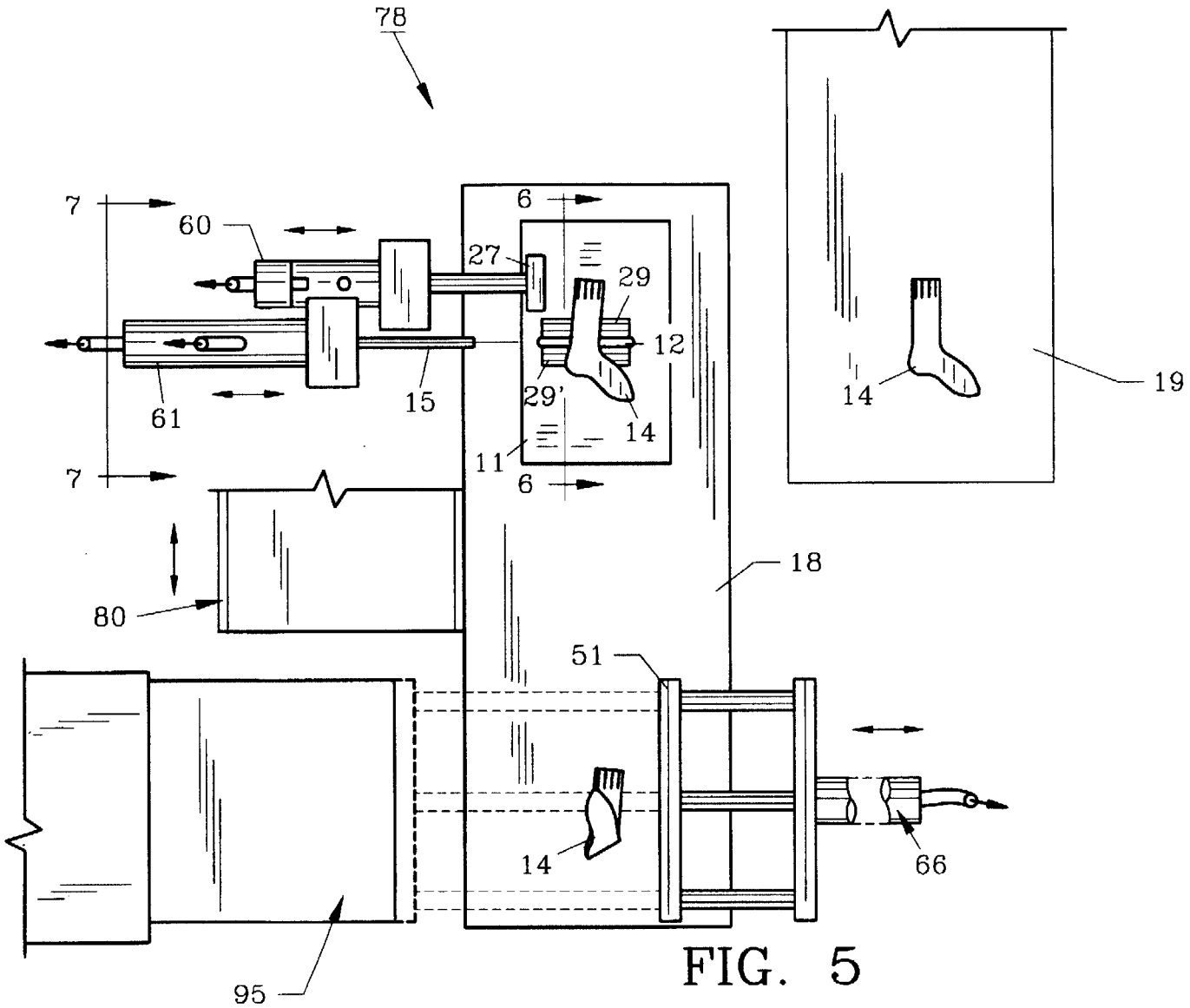
FIG. 5 is a top plan view of the preferred sock folding station taken along lines 5—5 in FIG. 1.

FIG. 5 is a top plan view of folding station 78 demonstrating sock 14 approaching folding plate 11 on upper conveyor 19. Vacuum plate 31 (see FIG. 1) transfers socks 14 precisely onto folding plate 11. Folding plate 11 is preferably level and has a generally flat planar upper surface. Folding plate 11 defines elongates slot 12, which is preferably rectangular. A pair of auxiliary, unpowered rollers 29 and 29' are provided parallel to slot 12 to allow socks 14 to pass through slot 12 without damage. Pair alignment device 27 is positioned proximate slot 12 to adjust the alignment of socks 14 relative to slot 12, if necessary. Pair alignment device 27 is joined to pneumatic unit 60, which precisely moves pair alignment device 27. Blade 15 is also positioned proximate slot 12, and tucks sock 14 into slot 12. Blade 15 is sized to fit within slot 12 as it tucks sock 14 therein. Blade 15 is joined to pneumatic units 61 and 62, which move blade 15 horizontally and vertically, respectively. As socks 14 are folded, they fall through slot 12 onto lower conveyor 18, and are eventually pushed to trimming/stacking station 79 by pair pusher plate 51 joined to pneumatic unit 66.

Figure 6:
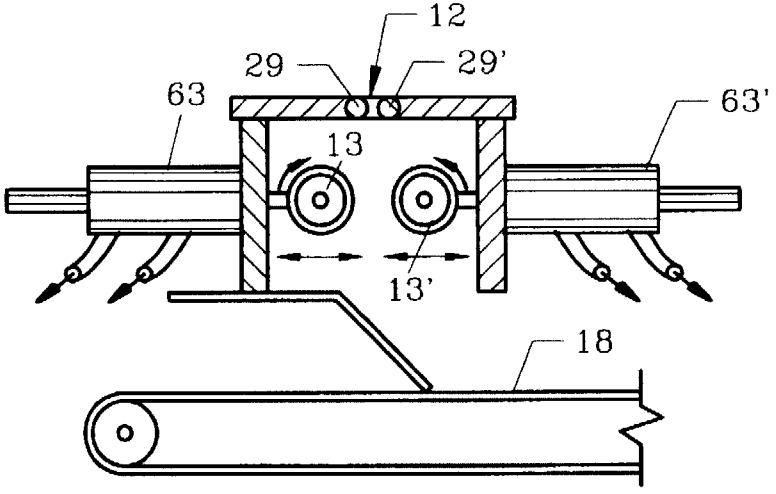
FIG. 6 is a side elevational view taken along lines 6—6 of FIG. 5.
Figure 7:
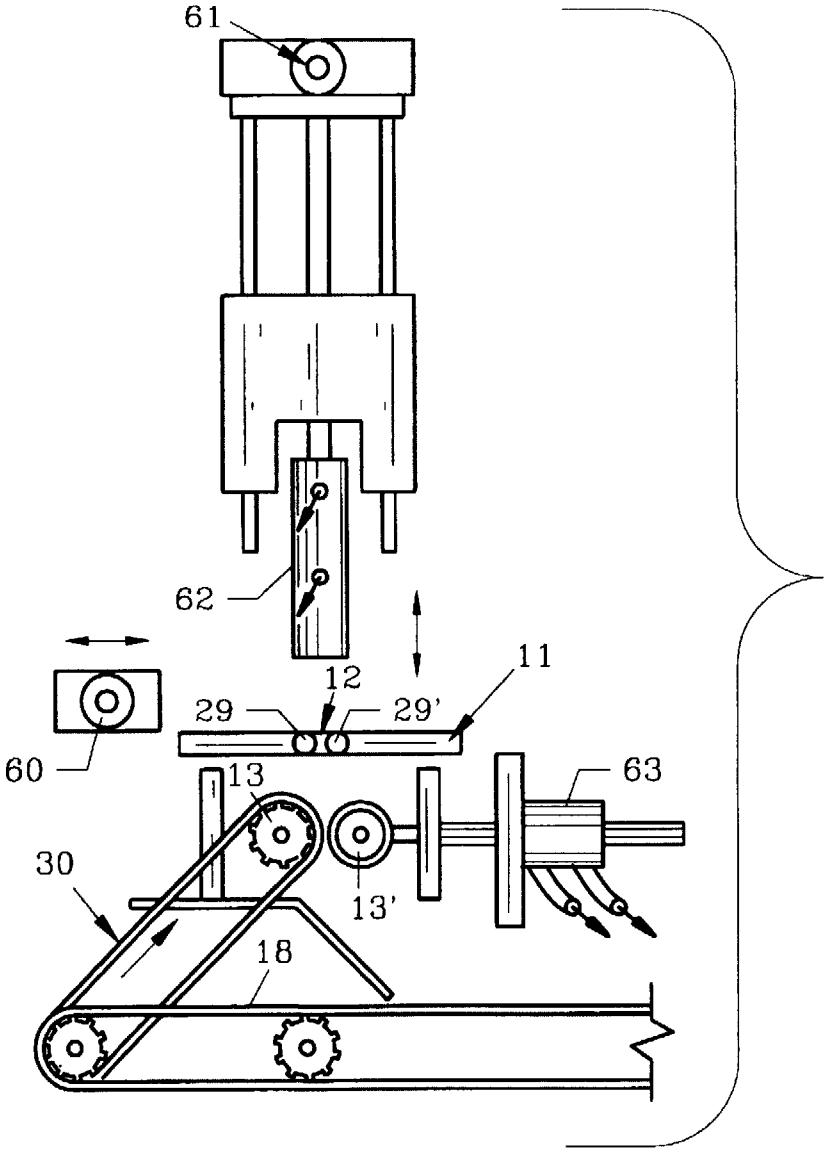
FIG. 7 is a side elevational view taken along lines 7—7 of FIG. 5.

Side views of apparatus 10 are seen in FIGS. 6 and 7 taken along the lines 6—6 and 7—7, respectively, in FIG. 5. Folding plate 11 defines slot 12. On either side of slot 12 are two opposing unpowered rollers 29 and 29'. Unpowered rollers 29 and 29' act as bearings to allow socks 14 to pass through slot 12 without damage. Beneath slot 12 are two opposing powered rollers 13 and 13'. Rollers 13 and 13' rotate selectively in opposite directions and are driven by drive belt 30. Also, rollers 13 and 13' are movable laterally toward and away from slot 12. In FIG. 6, rollers 13 and 13' are shown spaced apart, while in FIG. 7, rollers 13 and 13' are shown closer together. Rollers 13 and 13' are joined to and moved laterally by roller pneumatic units 63 and 63'. Pair alignment pneumatic unit 60, tucker blade pneumatic unit 61, and tucker blade pneumatic unit 62 are also shown in FIG. 7.

Figure 8:
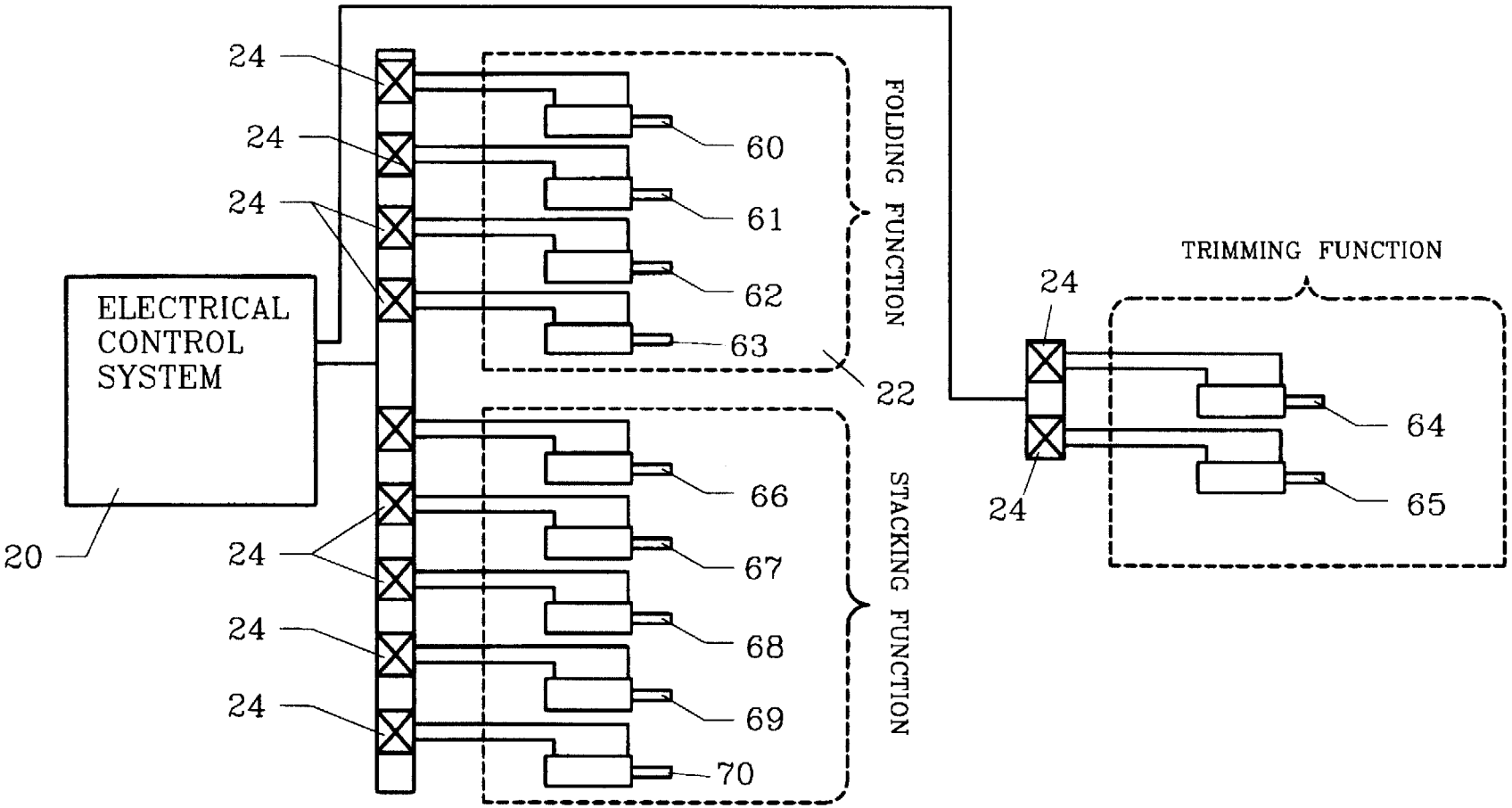
FIG. 8 is a schematic view of the preferred electrical and pneumatic components used to control the apparatus of the invention.
Figure 12:
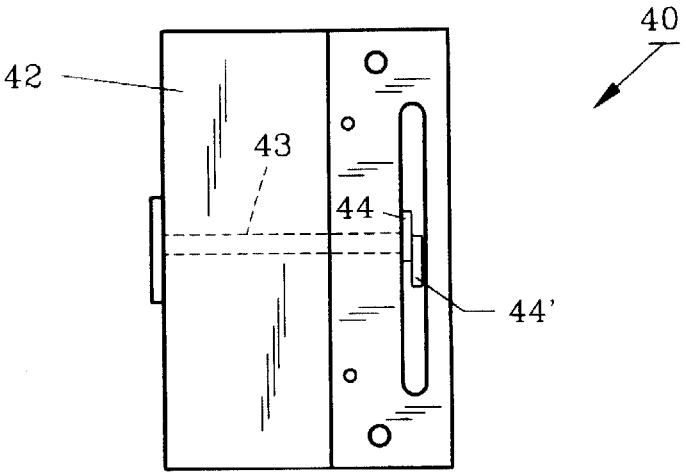
FIG. 12 is a top view of the lower housing of the trimmer head with the upper housing removed, exposing the blade drive mechanism.
Figure 10:
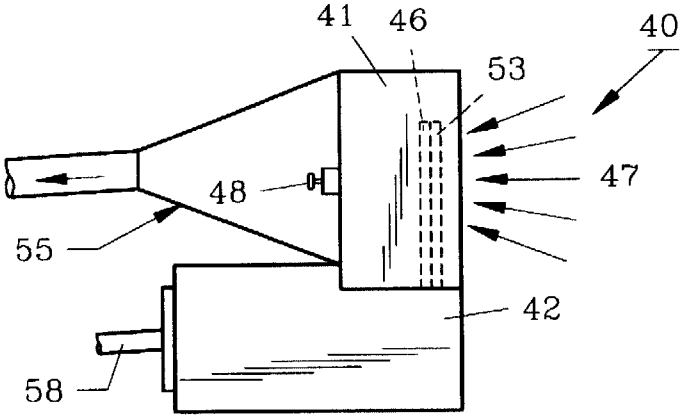
FIG. 10 is a side elevational view of the trimmer head, as shown in FIG. 9 along lines 10—10.

FIG. 8 is a schematic diagram of the preferred electrical and pneumatic systems used to control sock processing apparatus 10. Electrical system 20 comprises a programmable logic controller (PLC) that monitors the status of the several components of sock processing apparatus 10, and coordinates the movements of those components. Electrical system 20 generates output signals that activate the several pneumatic valves 24. One pneumatic valve 24 controls the operation of one pneumatic unit (60 through 70). Those skilled in the art can select specific components and circuits, depending on the exact configurations needed.

Folding function control system 22 comprises pneumatic units 60, 61, 62, and 63, which control pair alignment device 27, the horizontal movement of blade 15, the vertical movement of blade 15, and the lateral movement of rollers 13 and 13', respectively. Stacking function control system 23 comprises pneumatic units 66, 67, 68, 69, and 70, which control pair pusher 51, upper stacker plate 81, lower stacker plate 82, dead plate 80, and stack pusher 83. Trimming function control system 32 comprises pneumatic units 64 and 65, which control the horizontal and vertical movements of trimmer head 40, respectively.

FIGS. 9–12 provide views of trimmer head 40 and its several components. Trimmer head 40 comprises upper housing 41 and lower housing 42. Upper housing 41 defines opening 47, in which are placed first (front) blade 46 and second (rear) blade 50, slidably engaged. Upper housing 41 also provides screws 48, which allow vacuum hose cowl 55 to be sealed to upper housing 41 to draw a vacuum through opening 47 and blades 46 and 50. Blades 46 and 50 each include a lobe socket 45.

Lower housing 42 defines passageway 49 (FIG. 12), which carries crankshaft 43. Crankshaft 43 includes on one end two lobes 44 and 44'. Lobes 44 and 44' are eccentrically joined to crankshaft 43, and are oriented on crankshaft 43 180° apart. Lobes 44 and 44' engage each of sockets 45 on blades 46 and 50 respectively. Thus, crankshaft 43 drives blades 46 and 50, causing said blades to reciprocate for trimming purposes. On its other end, crankshaft 43 mounts to a suitable source of torque, preferably drive shaft 58.

Figure 11:
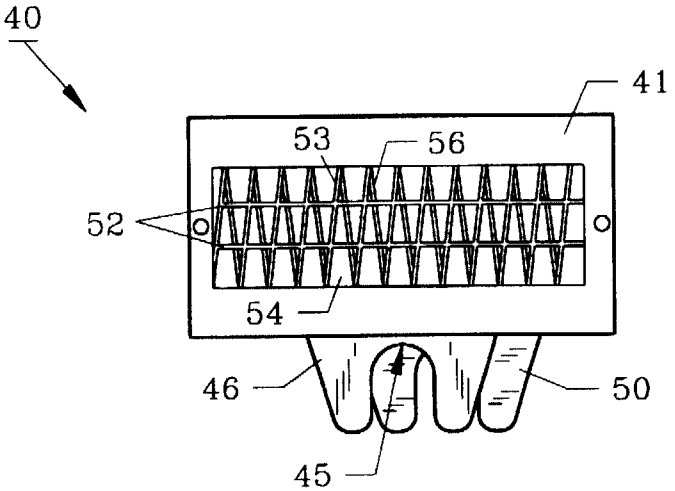
FIG. 11 is a front view of the upper housing of the trimmer head removed from the housing.
Figure 9:
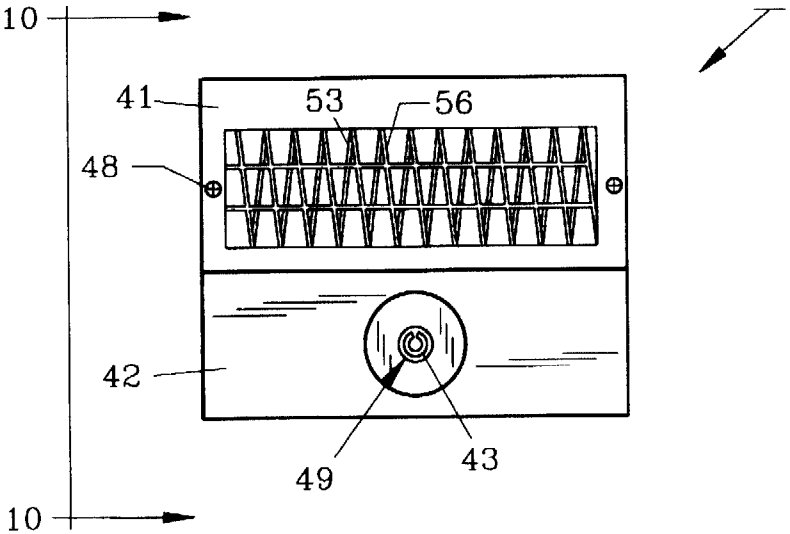
FIG. 9 is a rear view of the preferred trimmer head of the invention.

Blades 46 and 50 each include a plurality of horizontal bars 52 and vertical bars 53. Each horizontal bar 52 is disposed angularly to vertical bars 53, as seen in FIGS. 9 and 11, thus defining a plurality of somewhat rectangular openings 54. Note that vertical bars 53 in front blade 46 are oppositely angled relative to vertical bars 53 in rear blade 50. This opposite angling provides blades 46 and 50 with a "scissoring" cutting action when blades 46 and 50 are reciprocated by rotating drive shaft 58 powered by an electric motor (not shown). Also, horizontal bars 52 prevent socks 14 from being drawn into trimmer head 40; therefore, only excess threads can enter cutting openings 54.

In the preferred method, sock folding apparatus 10 operates as follows: First, an unfolded sock 14 approaches folding apparatus 10 along upper conveyor 19, and is placed precisely onto folding plate 11 by vacuum plate 31. A pair of socks 14 are eventually positioned lengthwise across slot 12. Pair alignment device 27 will extend to horizontally rotate and correctly align socks 14 relative to slot 12, if necessary.

As a pair of socks 14 are properly positioned across slot 12, pneumatic unit 61 positions blade 15 above slot 12, and pneumatic unit 62 moves blade 15 downwardly as blade 15 passes into slot 12. Thus, blade 15 tucks socks 14 into slot 12, creating a folded edge in socks 14 and beginning the folding process. After pushing the folded edge past the centerline of rollers 13 and 13', blade 15 withdraws from plate 11 and returns to its rest position, awaiting the next pair of socks 14.

After socks 14 are tucked into slot 12, rollers 13 and 13' are moved toward slot 12 to engage tucked socks 14. After rollers 13 and 13' engage socks 14, rollers 13 and 13' rotate. This rotation squeezes socks 14, pulling them through slot 12, while maintaining the folded edge created by blade 15. Also, rollers 13 and 13' compress socks 14, thus presenting a cleanly, neatly folded sock pair. As socks 14 pass completely through slot 12, they fall beneath folding plate 11 onto lower conveyor 18 to be transported to trimmer head 40. Rollers 13 and 13' then retract from slot 12, and the process is repeated with a new sock pair.

Lower conveyor 18 delivers folded socks 14 to pair pusher 51, which then pushes socks 14 onto dead plate 80. Upper pair stacker plate 81 moves downward toward dead plate 80, trapping socks 14 therebetween. Upper pair stacker plate 81 also further compresses socks 14, promoting a clean final appearance. While socks 14 remain trapped between plate 80 and stacker plate 81, trimmer head 40 moves horizontally and vertically into position to trim any excess threads. After trimming is complete, trimmer head 40 returns to its rest position, while socks 14 remain atop dead plate 80.

After socks 14 are trimmed, they are stacked. Lower stacker plate 82 moves up into position just below dead plate 80. Any existing folded pairs of socks 14 will be already stacked on lower stacker plate 82. When lower stacker plate 82 is in position, dead plate 80 is horizontally withdrawn, thus depositing socks 14 formerly positioned upon dead plate 80 atop lower stacker plate 82, and atop any sock pairs therebefore. Lower stacker plate 82 and upper stacker plate 81 then return to their rest positions, with its stack of folded socks 14 increased. Dead plate 80 simultaneously slides horizontally to its former position.

After stacking, socks 14 are compressed. When the sock stack reaches a preset value, it is moved by stack pusher 83 to compression station 90. Compression station 90 includes compression plate 91 joined to hydraulic cylinder 92. When stack pusher 83 positions a stack of socks 14 beneath compression plate 91, hydraulic cylinder 92 presses compression plate 91 down against the stack of socks 14. Compression plate 91 lowers until it is fully extended or the pressure relief setting is exceeded. Compression plate 91 maintains pressure upon the stack of socks 14 until a preset time interval has elapsed. When that interval expires, compression plate 91 is withdrawn to its rest position, and the sock stack moves on for bagging, sealing, and shipment.

The illustrations and examples provided herein are for explanatory purposes and are not intended to limit the scope of the appended claims.

I claim:

1. A sock processing apparatus comprising:

(a) a plate, said plate defining an elongated slot;

(b) a first pair of rollers, said pair of rollers adjacent said slot, said pair of rollers freely rotatable and unpowered;

(c) a blade positioned proximate said slot and movable into said slot, said blade for selectively tucking socks into said slot;

(d) a first powered roller, said first powered roller positioned proximate said slot; and (e) a fourth roller, said fourth roller positioned proximate said slot, wherein said first powered roller and said fourth roller are movable laterally to engage said socks.

2. The apparatus of claim 1, wherein the axes of said first powered roller and said fourth roller are parallel to the longitudinal axis of said slot.

3. The apparatus of claim 1, wherein said first powered roller and said fourth roller are opposingly positioned relative to said slot, and below said first pair of unpowered rollers.

4. The apparatus of claim 1, further comprising a pair alignment device positioned proximate said slot, said pair alignment device for rotating the socks into proper alignment with said slot.

5. The apparatus of claim 1, wherein said blade is sized to fit into said slot.

6. The apparatus of claim 1, wherein said slot is rectangularly shaped.

7. The apparatus of claim 1, further comprising means for driving said first powered roller, said driving means connected to said first powered roller.

8. The apparatus of claim 1, further comprising a vacuum plate, said vacuum plate positioned proximate said plate, said vacuum plate for placing socks on said plate.

9. The apparatus of claim 8, wherein said vacuum plate moves vertically and laterally.

10. The apparatus of claim 8 further comprising a shock absorber, said shock absorber positioned proximate said vacuum plate.

11. A sock folder comprising:

(a) a plate, said plate defining an elongated rectangular slot;

(b) a blade, said blade positioned proximate said slot and movable thereinto, said blade for selectively tucking socks into said slot;

(c) means for moving said blade, said blade moving means joined to said blade;

(d) a pair of powered rollers positioned beneath said slot;

(e) a roller pneumatic unit joined to said rollers, said roller pneumatic unit for moving said rollers laterally toward one another to engage the sock;

(f) means for turning said rollers, said roller turning means in electrical communication with said rollers so that said rollers turn after they engage the socks; and (g) a pair of unpowered rollers, said unpowered rollers positioned adjacent said slot.

12. The sock folder of claim 11, wherein said powered rollers are opposingly positioned.

13. The sock folder of claim 11, wherein the axes of said powered rollers are parallel with the longitudinal axis of said slot.

14. The sock folder of claim 11, wherein said blade is sized to fit said slot.

15. The sock folder of claim 11, further comprising a lower conveyor, said lower conveyor positioned beneath said plate.

16. A method of folding socks, the method comprising the steps of:

(a) providing a plate having an elongated slot, a first pair of unpowered rollers and a second pair of powered rollers positioned proximate the slot;

(b) placing a sock across the slot;

(c) tucking the sock into the slot;

(d) cushioning the movement of the sock with the unpowered rollers;

(e) compressing the sock by laterally closing the pair of powered rollers upon the socks; and (f) pulling the sock through the slot with the powered rollers to thereby fold the sock.

17. The method of claim 16, further comprising the step of aligning the sock with the slot.

18. The method of claim 17, further comprising moving the powered rollers toward one another to engage the sock.

19. The method of claim 16, wherein tucking the sock comprises tucking the sock with a blade positioned above the slot.

20. The method of claim 16, wherein pulling the sock comprises turning the powered rollers to pull the sock.

21. A method of processing socks, the method comprising the steps of:

(a) picking up the socks with a vacuum plate;

(b) placing the socks on a plate with a slot;

(c) folding the socks by tucking them into the slot in the plate, laterally closing a pair of rollers upon the socks, and turning the rollers to pull the socks through the slot;

(d) trimming loose threads from the socks;

(e) stacking the socks; and (f) compressing the socks to remove air from the socks.

22. The method of claim 21, wherein folding the socks comprises aligning the socks on the plate relative to the slot.

23. The method of claim 21, wherein compressing the socks comprises compressing the socks after the socks are stacked.

24. The method of claim 21, wherein the step of stacking the socks comprises the steps of:

(a) providing a movable dead plate and a movable lower stacker plate;

(b) positioning a folded sock on the dead plate;

(c) raising the lower stacker plate towards the dead plate;

(d) moving the dead plate horizontally so as to drop the socks positioned thereon onto the lower stacker plate; and (e) repeating steps (a)–(d) to create a stack of socks.

* * * * *